US005827089A

United States Patent [19]

Beck, Jr.

[11] Patent Number: 5,827,089

[45] Date of Patent: Oct. 27, 1998

[54] BOARD LOCK FOR ELECTRICAL CONNECTOR

[75] Inventor: Hoy Smith Beck, Jr., Lexington, N.C.

[73] Assignee: The Whitaker Corporation, Wilmington, Del.

[21] Appl. No.: 743,569

[22] Filed: Nov. 4, 1996

Related U.S. Application Data

[63] Continuation of Ser. No. 437,339, May 9, 1995, abandoned.

[51] Int. Cl.[6] ..... H01R 13/73

[52] U.S. Cl. ..... 439/567

[58] Field of Search ..... 439/567, 571, 439/572

[56] References Cited

U.S. PATENT DOCUMENTS

| | | | |
|---|---|---|---|
| 4,668,040 | 5/1987 | Matsuzaki et al. | 339/125 R |
| 4,907,987 | 3/1990 | Douty et al. | 439/571 |
| 4,943,244 | 7/1990 | Teck et al. | 439/567 |
| 5,021,009 | 6/1991 | Cox | 439/538 |
| 5,074,807 | 12/1991 | Parmer | 439/567 |
| 5,085,589 | 2/1992 | Kan | 439/92 |
| 5,154,634 | 10/1992 | Brown et al. | 439/567 |
| 5,171,165 | 12/1992 | Hwang | 439/567 |
| 5,176,349 | 1/1993 | Bendorf | 248/220.2 |
| 5,184,963 | 2/1993 | Ishikawa | 439/79 |
| 5,244,412 | 9/1993 | Hatch et al. | 439/567 |
| 5,257,947 | 11/1993 | Scheer et al. | 439/567 |
| 5,257,948 | 11/1993 | Peterson | 439/571 |
| 5,334,049 | 8/1994 | Kachlic et al. | 439/567 |
| 5,340,321 | 8/1994 | Hashiguchi et al. | 439/108 |
| 5,393,247 | 2/1995 | DiOrazio et al. | 439/567 |

FOREIGN PATENT DOCUMENTS

| | | |
|---|---|---|
| 2 239 135 | 6/1991 | European Pat. Off. . |
| 0 482 669 | 4/1992 | European Pat. Off. . |
| 57-43341 | of 1982 | Japan . |
| 61-28905 | 2/1986 | Japan . |

*Primary Examiner*—Gary F. Paumen
*Attorney, Agent, or Firm*—T. J. Aberle

[57] ABSTRACT

A board lock (20) formed of flat stock for disposition in a slot (16) of an electrical connector housing (11). The board lock includes sharpened barbs (26*a*) formed on resilient legs (26) thereof. The board lock (20) is frictionally retained within the housing (11) by action of upper and lower arms (23,24) which frictionally engage the housing.

16 Claims, 1 Drawing Sheet

BOARD LOCK FOR ELECTRICAL CONNECTOR

This application is a Continuation of application Ser. No. 08/437,339 filed May 9, 1995, now abandoned.

The present invention relates to a board lock member for use with an electrical connector to be mounted to a flat surface, for example, a printed circuit board (PCB). More particularly, the present invention relates to a board lock which is inserted into a side of an electrical connector, and makes frictional engagement with the PCB by virtue of deflectable legs formed on the board lock.

BACKGROUND OF THE INVENTION

A known electrical connector employing a board lock member is disclosed in U.S. Pat. No. 5,184,963 which is hereby incorporated by reference in its entirety. The board lock described in this reference is inserted into a top side of the electrical connector and is retained in place when a slidable top half of the electrical connector is mated to a bottom half of the electrical connector. Resilient legs of the board lock member are disposed within a post of the bottom half of the electrical connector. This known board lock member provides an advantageous way of mounting an electrical connector to a PCB; however, the retention means by which the board lock is retained in the connector housing requires much space. Moreover, the board lock can be inadvertently removed from the bottom half of the electrical connector when the top half is removed. Additionally, having the board lock member inserted from a top side presents a problem where it is desired to remove the board lock member but the top half of the connector is inaccessible.

Another known board lock member is disclosed in U.S. Pat. No. 4,907,987. The board lock member disclosed in this reference is inserted into a back side of an electrical connector but requires a right-angle flange which extends transversely of the insertion direction of the board lock member. This configuration requires an extra layer of housing material along a bottom surface of the electrical connector wherein a groove is formed for receipt of the flange. This board lock advantageously has the capability of mounting an electrical connector to a PCB; however, this device requires more space because of the extra layer of material on the bottom of the connector housing, and requires metal material which comprises the flange portion of the board lock.

The present invention seeks to overcome the deficiencies of the prior board lock members by providing a board lock member which cannot be inadvertently removed from its position in a connector housing, provides easy side access for insertion or removal, is space efficient in that it does not require additional housing material for its insertion area into the connector housing, but is inexpensively made because it is stamped out of a blank of spring brass without the need for bending or deformation in the final product.

SUMMARY OF THE INVENTION

The present invention provides a board lock member for use with an electrical connector comprising: a generally flat body portion comprising an upper arm and a lower arm with a space therebetween; and a pair of deflectable legs which extend from the body portion.

DETAILED DESCRIPTION OF THE INVENTION

Figure 1:
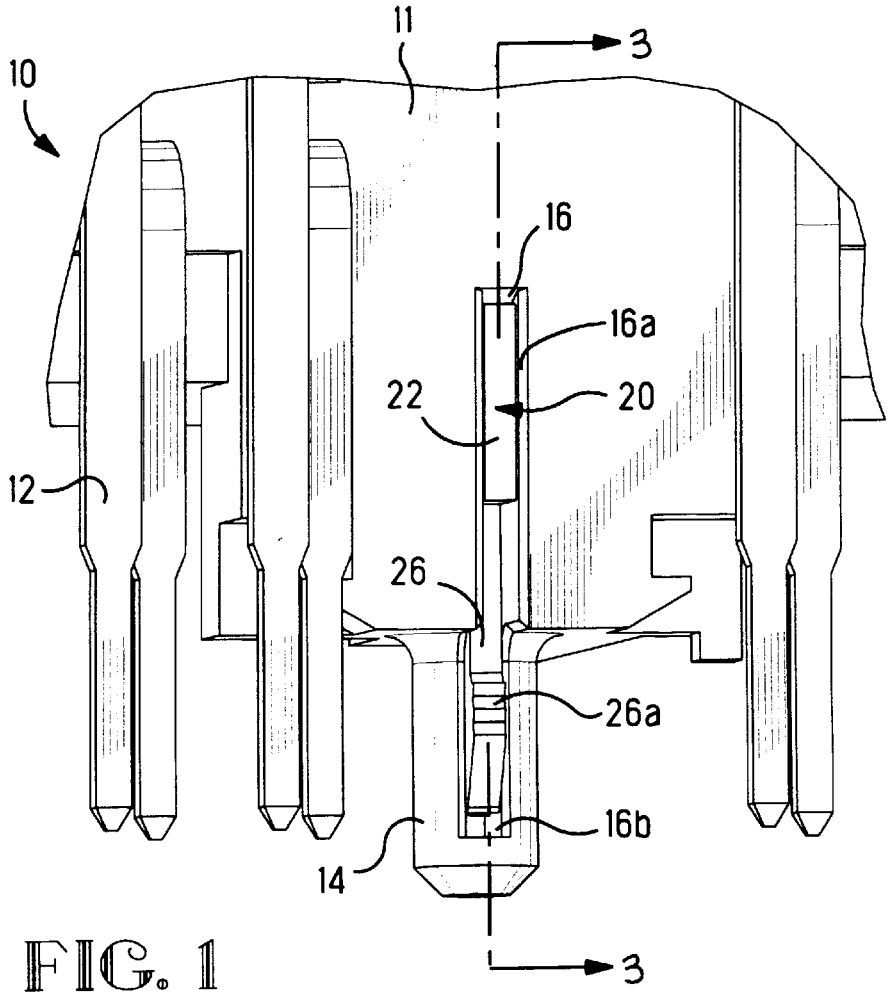
FIG. 1 shows a perspective view of the board lock according to the present invention when it has been inserted into a side surface of an electrical connector housing.
Figure 3:
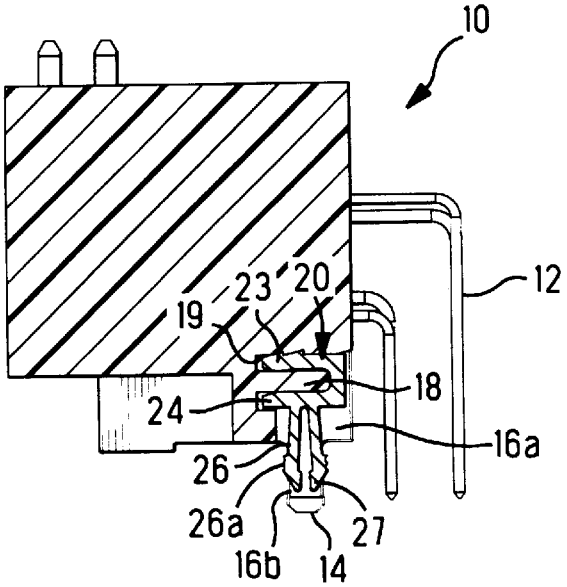
FIG. 3 is a side cross sectional view of the board lock and connector housing of FIG. 1 taken along line 3—3.

FIG. 1 shows an electrical connector 10 for mounting on, for example, a PCB (not shown in the drawing). Electrical connector 10 includes a housing 11 made of a suitable dielectric material, electrical contacts 12, a post 14, slot 16 comprising a housing slot 16*a* and a post slot 16*b*, and a wedge portion 18 and an upper chamber 19 (as shown in FIG. 3). A board lock 20 is shown disposed within slot 16 with a body portion 22 disposed in housing slot 16*a*, and leg 26 disposed in post slot 16*b* with barbs 26*a* projecting from the cylindrical surface of post 14. An advantage of having a post 14 on a connector housing is that, when the post is inserted into a hole in a PCB, it can serve to precisely align contacts 12 with circuit traces on a PCB. Additionally, slot 16 is advantageously placed between the rows of contacts 12 for accommodating the board lock 20 so that additional space is not required for the board lock 20.

Figure 2:
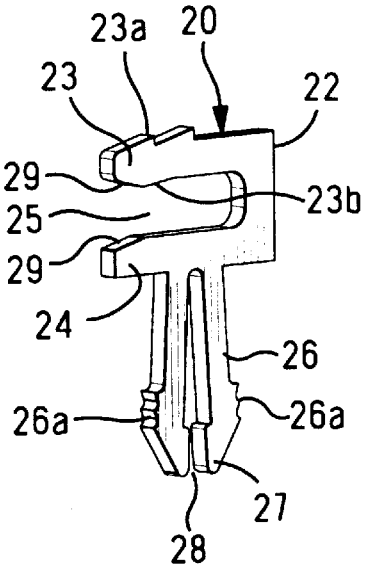
FIG. 2 is an isometric view of the board lock according to the present invention.

Referring to FIG. 2, a more thorough description of board lock 20 will not be provided. Board lock 20 includes a body portion 22 having an upper arm 23 with barbs 23*a* and a grip surface 23*b*, and a lower arm 24. There is a space 25 between arms 23 and 24 for receipt of housing wedge 18 as shown in FIG. 3. Legs 26 are resiliently deflectable and include sharpened barbs 26*a* and tapered sections 27. A gap 28 disposed between legs 26 for the purpose of providing room for deflection of the legs 26 when the board lock is being inserted into a PCB hole. Board lock 20 is preferably stamped from flat metal stock, typically a spring brass. In another advantage of the invention, the board lock 20 is formed without the formation of bends in the material, thereby reducing the cost of manufacture of the board lock.

Referring now to FIG. 3, the board lock 20 will be described as shown inserted into housing 11. Upper arm 23 of board lock 20 retains the board lock 20 within housing 11 as it includes sharpened barbs 23*a* which frictionally engage the housing, and a bottom surface of arm 23 includes grip surface 23*b* for engaging an upper surface of wedge 18. Tapers 29 are formed adjacent to gap 25 of board lock 20 so that when board lock 20 is inserted into slot 16 the front edges of arms 23 and 24 will not stub on wedge 18. As board lock 20 is inserted into slot 16, upper and lower arms 23 and 24 will spread apart but will resiliently frictionally engage wedge 18. Thus, the present invention solves the problem of adequately retaining the board lock 20 in the connector housing without requiring the formation of bends in the flat stock material. Legs 26 are shown disposed in post slot 16*b* with sharpened barbs 26*a* projecting outwardly therefrom, which advantageously allows the board lock to be used for different thicknesses of PCBs. Moreover, since the board lock 20 is formed of flat stock material it minimizes the amount of space required in the connector housing to accommodate it therein.

Thus a preferred embodiment of the present invention has been disclosed. It is to be understood, however, that the invention is not to be strictly limited to such embodiment but may be otherwise variously embodied and practiced within the scope of the appended claims. For example, it is contemplated that the housing slot can be formed with recesses disposed laterally thereof for allowing a tool to grip body 22 of board lock 20 thereby facilitating removal of the board lock 20 from the housing 11. Additionally, it is contemplated that the board lock can be formed of other spring materials, for example, a spring steel material. Moreover, it is contemplated that the barbs 23*a* can be formed along a bottom surface of upper arm 23, and the grip surface can be formed on a top surface of upper arm 23. This arrangement would advantageously facilitate proper installation and placement of the board lock 20.

Accordingly, what is claimed is:

1. A board lock member for use with an electrical connector, comprising:

a generally flat body portion comprising an upper arm and a lower arm with a space therebetween;

a pair of deflectable legs which extend from said lower arm in an axial direction;

said upper and lower arms extend in a direction which is generally transverse to said axial direction of said deflectable legs, said upper and lower arms comprise respective first ends which are connected by a web section, and each of said upper and lower arms comprise respective second ends, said second ends comprise free ends which are substantially coextensive in said transverse direction, said upper and lower arms thereby define a hook-shaped configuration for attaching the board lock to said electrical connector, said upper arm having a retention member.

2. The board lock of claim 1, wherein said upper arm includes barbs which extend therefrom.

3. The board lock of claim 2, wherein said upper arm includes a grip surface which extends therefrom.

4. The board lock of claim 1, wherein said legs include barbs which extend therefrom.

5. The board lock of claim 1, wherein said board lock is formed of a generally flat piece of stamped stock material without having bends formed in said material.

6. The board lock of claim 1, wherein said board lock consists of a generally planar piece of flat stock material so that all of said body portion is generally in the same plane as said legs.

7. An electrical component for receiving at least one electrical contact therein and for mounting to a surface, said component comprising:

a housing having a mounting portion for mounting to said surface and side portions adjacent said mounting portion, and at least one slot formed in one of said side portions and said mounting portion for receiving a board lock member, said slot comprises a void space in said component, a portion of said void space is operative to laterally receive a body section of said board lock member as said board lock member is moved into said portion of said void space; and said board lock member including a generally flat body portion comprising an upper arm and a lower arm with a space therebetween, said upper arm having a retention member for engaging said slot, a pair of deflectable legs which extend from said lower arm in an axial direction, said upper and lower arms extend in a direction which is generally transverse to said axial direction of said deflectable legs, said upper and lower arms comprise respective first ends which are connected by a web section, and each of said upper and lower arms comprise respective second ends, said second ends comprise free ends which are substantially coextensive in said transverse direction, said upper and lower arms thereby define a hook-shaped configuration for attaching the board lock to said electrical connector.

8. The electrical component of claim 7, wherein said body portion comprises upper and lower arms with a gap therebetween thereby defining said hook-shaped section.

9. The electrical component of claim 8, wherein said gap accommodates a wedge projection formed on said component which wedge engages said upper and lower arms, said wedge thereby becomes wedged between said upper and lower arms and frictionally retains said board lock within said housing.

10. The electrical component of claim 8, wherein at least one of said arms includes an enlarged thickness comprising a grip surface, and said gap is narrowed in the region of said grip surface.

11. The electrical component of claim 10, wherein said gap accommodates a wedge projection formed on said component which engages said upper and lower arms thereby wedging between said upper and lower arms and frictionally retaining said board lock within said housing.

12. The electrical component of claim 8, wherein said upper arm includes at least one barb formed on an upper surface thereof, and a wedge projection is formed on said component which engages said upper arm thereby wedging said upper arm in a chamber of said housing and forcing said barb into frictional engagement with said housing.

13. The electrical component of claim 7, wherein said component includes a post member formed thereon, said post member comprises a portion of said slot, and a portion of said at least one leg protrudes out of said slot.

14. The electrical component of claim 7, wherein said board lock is formed of a generally flat piece of stamped stock material without having bends formed in said material.

15. The electrical component of claim 7, wherein said board lock consists of a generally planar piece of flat stock material so that all of said body portion is generally in the same plane as said leg.

16. The electrical component of claim 7, wherein said slot is a straight slot which extends into a post formed on said component for receiving said board lock member.

* * * * *